United States Patent [19]

Hough

[11] Patent Number: 4,607,648

[45] Date of Patent: Aug. 26, 1986

[54] COIN BANK WITH FLIPPING ACTION AND SORTING

[75] Inventor: Wilfred H. Hough, Cleveland, Ohio

[73] Assignee: Nottingham-Spirk Design Inc., Cleveland, Ohio

[21] Appl. No.: 735,318

[22] Filed: May 17, 1985

[51] Int. Cl.[4] ..... G07D 3/00

[52] U.S. Cl. ..... 133/3 D; 446/8

[58] Field of Search ..... 133/3 R, 3 C, 3 D, 3 H, 133/3 E; 446/8, 10, 3, 168, 169, 171, 11, 12, 9, 13

[56] References Cited

U.S. PATENT DOCUMENTS

| | | | |
|---|---|---|---|
| D. 103,605 | 3/1937 | Zell . | |
| D. 161,937 | 2/1951 | Kelly . | |
| D. 177,002 | 3/1956 | Barker . | |
| D. 197,786 | 3/1964 | Pierce, Jr. . | |
| D. 270,868 | 10/1983 | Spirk, Jr. . | |
| 2,260,768 | 10/1941 | Bee | 446/12 |
| 2,749,656 | 6/1956 | Reynolds . | |
| 3,135,270 | 6/1964 | Arnold | 133/3 R |
| 3,143,285 | 8/1964 | Fulton . | |
| 3,313,477 | 4/1967 | Brown . | |
| 3,387,616 | 6/1968 | Bortz et al. . | |
| 3,521,649 | 3/1967 | Warrix . | |
| 3,621,854 | 11/1971 | Redman | 133/3 H |
| 3,882,659 | 5/1975 | Charlop | 133/1 A |
| 4,495,959 | 1/1985 | Farber | 133/3 D |

FOREIGN PATENT DOCUMENTS

| | | | |
|---|---|---|---|
| 2614560 | 4/1976 | Fed. Rep. of Germany | 133/3 H |

OTHER PUBLICATIONS

"Playful Penguin Race", 1983 Dah Yang Toy Co.
"Crank Bank", Mar. 10, 1965.

*Primary Examiner*—Joseph J. Rolla
*Assistant Examiner*—P. McCoy Smith
*Attorney, Agent, or Firm*—Renner, Otto, Boisselle & Lyon

[57] ABSTRACT

A coin bank for separating a group of coins, forming the coins into a moving file, and for sorting the coins. The bank has a housing with an inlet for receiving a group of coins, coin bins for receiving coins of different diameters, a mechanism for separating individual coins from a group deposited into the inlet and for advancing the separated coins in a moving file, and a mechanism for receiving coins from the moving file and for sorting the coins in respective coin bins. The housing has a transparent wall disposed so as to allow coins in the moving file to be viewed therethrough, to provide the bank with a unique visual effect.

19 Claims, 15 Drawing Figures

COIN BANK WITH FLIPPING ACTION AND SORTING

INTRODUCTION

This application realtes to a coin bank designed to receive a group of coins and to direct those coins to a storage area while providing a unique visual effect as the coins move toward the storage area. This application relates especially to a coin bank which takes a group of coins, separates the coins into a moving file, and manipulates (or animates) the coins as they move in the file. Still further, this application relates to a coin bank which has a unique structure for sorting the coins according to their diameters as the coins are directed to the coin storage area.

BACKGROUND

Coin banks which provide unique visual effects, and which sort coins according to their diameter, are becoming increasingly popular. Such banks are designed to encourage people to save coins, and, at the same time, to produce unique visual effects which can attract and amuse the user.

One type of coin sorting bank that also produces a visual effect is shown in U.S. Pat. No. D270,868. The patent discloses a molded plastic bank in which individual coins move toward a coin sorting area under gravitational/inertial forces. As the coins move toward the coin sorting area they engage a series of wheels and levers which help effect sorting, and which also provide a unique visual effect to attract and to amuse a user. The bank of U.S. Pat. No. D270,868 is basically designed to operate with individual coins deposited therein.

Another type of prior sorting bank is disclosed U.S. Pat. No. 4,511,341. In that bank, individual coins move, under gravitational/inertial forces, through a display area and to a sorting area. In the display area, the coins turn a wheel, and cause the wheel to rotate relative to a display wall. The rotation of the wheel relative to the display wall produces a moire effect which creates the illusion of animation of an image formed partly on the wheel and partly on the display wall. The coins then move into a sorting area containing coin bins and sorting tracks molded into the housing parts. In the sorting area the sorting tracks sort the coins into respective bins according to the diameters of the coins.

SUMMARY OF THE INVENTION

The present invention provides a coin bank, preferably a coin sorting bank, with a unique mode of operation, and a unique visual effect, in comparison to previous coin sorting banks. The bank of the invention is designed to take a group of coins, separate individual coins from the group and form the separated coins into a moving file. The bank has a transparent wall disposed so as to allow coins in the moving file to be viewed therethrough, and the movement of coins in the moving file provides a unique visual effect to the user. The coins are then directed to a coin sorting area in which the coins are sorted into respective coin bins according to the diameters of the coins.

A particularly unique aspect of this invention is the manner in which coins in the moving file are manipulated as they move behind the transparent wall. The coins are moved sequentially through a series of stations, and are manipulated as they move through each of the stations so as to provide a unique visual effect.

Preferably, the series of stations each includes a ledge, and a movable pusher is periodically (cyclically) operated to push each coin off of its respective ledge. The moveable member and the geometry of the ledges are designed so that as each coin is pushed off a ledge it is flipped over and is received on its opposite side on the succeeding ledge.

Unlike many previous coin banks, a bank according to the present invention operates with a group of coins which are simultaneously deposited into the bank. Upon introduction of a plurality of coins into the bank, a stack of coins forms at the first ledge, and the operation of the movable pusher is automatically initiated. The pusher operates cyclically to simultaneously (i) remove an individual coin from the bottom of the stack on the first ledge and push the separated coin off the first ledge, and (ii) push any coins that are on succeeding ledges off their respective ledges. Thus, the pusher operates to separate coins from the stack on the first ledge, and to manipulate coins that are on the succeeding ledges. The coins are effectively separated from the stack, and formed into a moving file in which each coin moves from ledge to ledge. Further, the coins are manipulated as they move from ledge to ledge, depending upon the geometry of the ledges and operation of the pusher.

Another unique and useful aspect of the invention is the manner in which the bank is constructed for sorting coins according to their diameters. In previous molded plastic sorting banks, the coin bins and the sorting tracks have been molded directly into the bank housing parts. Banks for handling different currencies required housing parts which needed to be individually molded for the particular currencies, because of the close tolarances required for the sorting tracks. With the bank of the present invention, coin bins are molded into the housing parts, and a separately molded sorting track member is connected with the housing parts, of the bank. The coin bins have diameters which enable them to handle coins of different diameter ranges. Thus, a single set of coin bins can handle coins of different currencies. The sorting track member is specially molded for handling coins of a particular currency. The sorting track member is connected with the housing parts and operates to sort coins of the particular currency into respective coin bins.

With the foregoing concept of the invention, a universal housing design can be created for use with a wide range of currencies, and the bank can be specially designed for a particular currency by specially molding the sorting track member to sort coins of that particular currency.

The further objects and advantages of the present invention will become further apparent from the following detailed description and the accompanying drawings.

DETAILED DESCRIPTION OF THE PREFERRED EMBODIMENT

The principles of the present invention are particularly useful in a coin sorting bank designed to take a group of coins, form them into a moving file and then sort them according to their diameters. The following description relates to a coin sorting bank, but it will be recognized by those of ordinary skill in the art that some of the principles of this invention can be utilized to form a novelty bank, without the sorting function.

Figure 1:
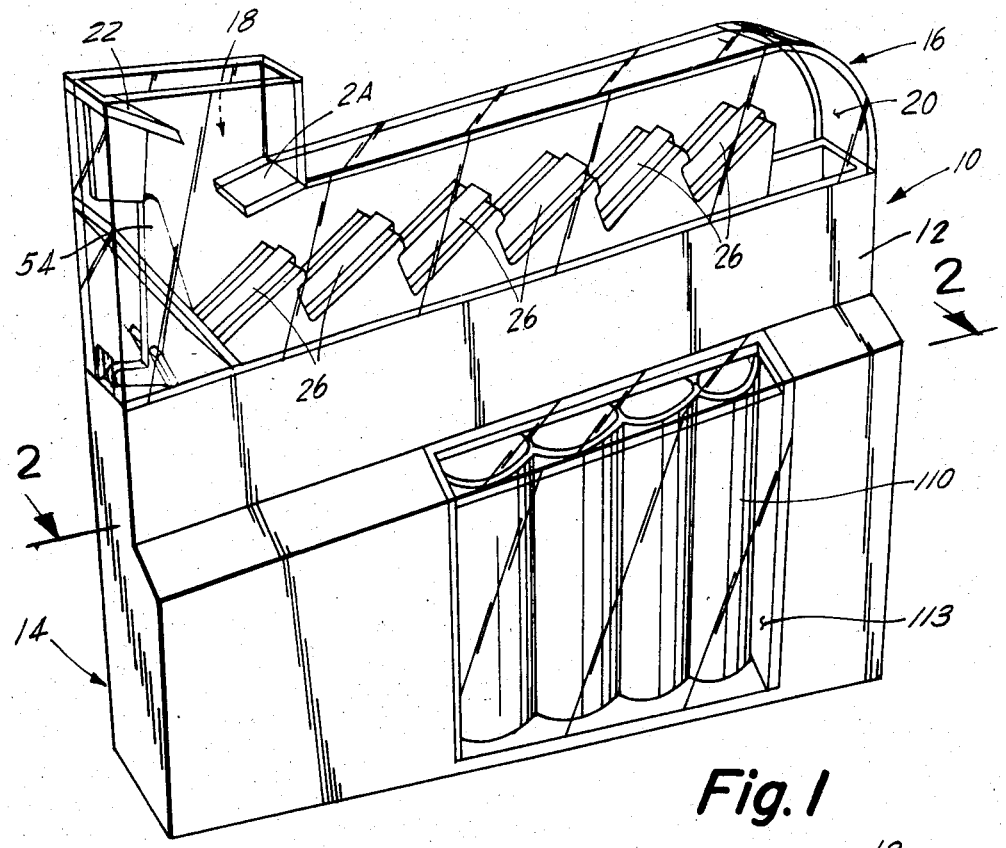
FIG. 1 is a three dimensional isometric view of a coin sorting bank constructed according to the principles of this invention.
Figure 6:
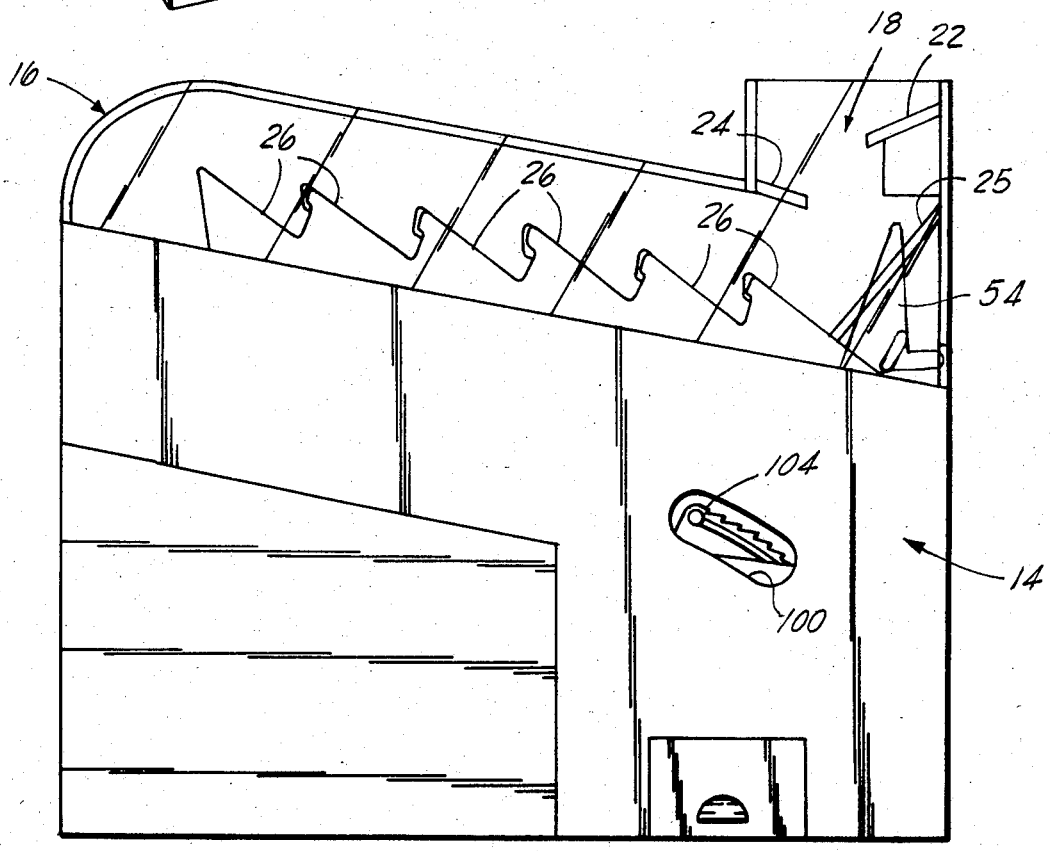
FIG. 6 is a rear elevational view of the bank of FIG. 1.

Referring to FIG. 1, a coin sorting bank according to the invention comprises a housing 10 which includes a molded plastic front member 12, a molded plastic back member 14, and a transparent, molded plastic top member 16. The bottom of the bank is molded with the front member.

The top member 16 has an inlet 18 for receiving coins. A mechanism for manipulating coins deposited into the inlet is disposed mainly between the front and back housing members 12,14, but extends at least partly above the front housing member 12, and into the area behind the transparent front wall 20 of the top member 16. Thus, the manipulation of coins behind the transparent front wall 20 is visible to a user, and provides a unique visual effect as the coins are manipulated.

The inlet 18 in the top member 16 is dimensioned to receive single coins or groups of coins. The inlet includes a pair of ledges 22,24, each extending downwardly at an angle. The ledges 22, 24 guide coins along a zig-zag path and, along with a wall 25 in the housing, form the coins into a stack as the coins reach the bottom of the inlet 18.

A series of ledges 26 are fixed in the housing. The ledges 26 comprise inclined ramps disposed so that the upper end of one ledge is disposed above the bottom end of a succeeding ledge. A first one of the ledges 26 is disposed below the inlet 18, for receiving coins deposited into the inlet. There is preferably a slight upward incline to the succession of ledges 26, so that coins are moved uphill, against gravity, as they are moved from the first ledge toward the last ledge.

The ledges 26 are fixed in the housing members. Parts of the ledges, shown at 26(*a*), are fixedly connected to, or formed integrally with, the front housing member 12. Other parts of the ledges, shown at 26(*b*), are fixedly connected to, or formed integrally with, the back housing member 14. Central portions of the ledges, shown at 26(*c*), are connected with the portions 26(*a*) and 26(*b*).

There are two slots 28(*a,b*) disposed between the portions 26(*a*), 26(*b*) and 26(*c*) of the ledges 26. The slots 28(*a,b*) allow a pusher 30 to move therebetween, for purposes described more fully hereinafter.

Figure 2:
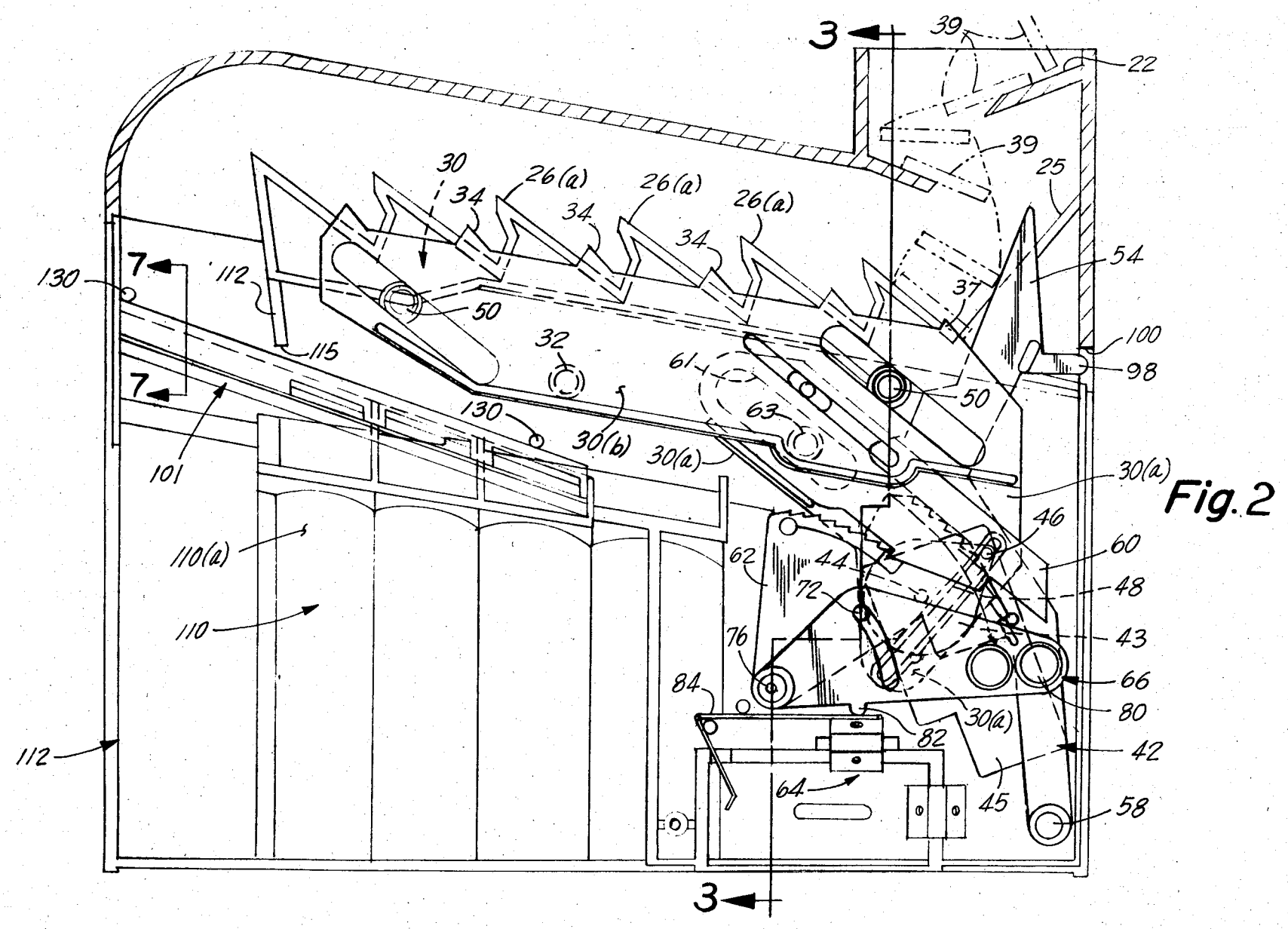
FIG. 2 is a longitudinal cross sectional assembly view of the bank of FIG. 1, taken from the direction 2—2, with some parts omitted.

The pusher 30 includes a driver pusher member 30(*a*) and a slave pusher member 30(*b*). The driver and slave pusher members are coupled together, e.g., by pins 32 and 63(FIG. 2), so that the driver and slave pusher members move in unison. Further, both the driver and slave pusher members have fingers 34 which move between the slots 28(*a,b*) in the ledges 26. The pusher 30 and its fingers 34 are cyclically reciprocated, in a manner described more fully hereinafter, and during each reciprocation the fingers 34 move along a path that moves them above the top surfaces 36 of the ledges 26, see FIG. 11(A–E). Upon each reciprocation of the pusher, its fingers 34 engage coins disposed on the ledges 26 and push the coins upward toward the upper ends of the ledges 26.

The pusher 30 has a finger 37(FIG. 2) that is associated with the first ledge 26. The finger 37 is shaped slightly differently than the fingers 34 associated with succeeding ledges. The finger 37 is designed to slice a single coin off the bottom of a stack forming against the first ledge, to separate the coin from a stack disposed on the first ledge and to push the separated coin off the first ledge.

According to the principles of this invention, each reciprocation of the pusher 30 effects removal of a coin from the bottom of a stack formed on the first ledge, and also pushes a coin off each succeeeding ledge. The manner in which coins(shown in phantom at 39 in the figures) which are received in the inlet 18 form a stack at the first ledge is schematically shown FIG. 2. The operation of the pusher 30, and the action of a coin 39 pushed off a ledge is schematically illustrated in FIGS. 11(A–E). As the coin is pushed off the ledge 26 it fulcrums about the end 40 of the ledge and turns or flips over so that its opposite side engages a succeeding ledge 26. The fingers 34,37 on the pusher are designed to be withdrawn during the reciprocating cycle of the pusher 30, and in a manner which does not interfere with the coins being flipped or otherwise deposited onto successive ledges.

Of course, while it is preferred to flip coins over as they move from ledge to ledge, it is contemplated that other forms of manipulation of the coins may be effected, depending upon the geometry of (i) the ledges, (ii) the pusher, and/or (iii) any other members that may be in the path of the coins. For example, the configuration of the ledges could be designed so that coins are dropped from one ledge to another without being flipped over.

Figure 3:
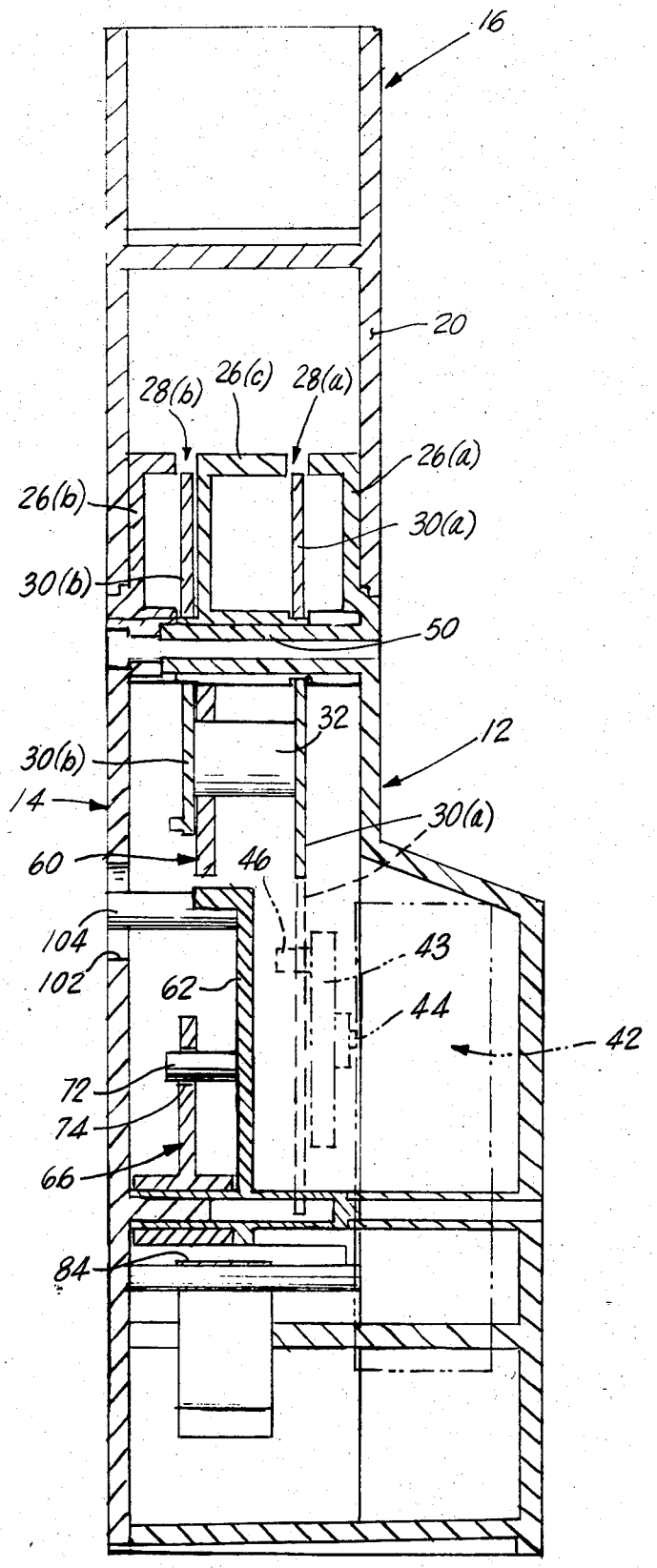
FIG. 3 is a sectional view of the bank of FIG. 2, taken along the line 3—3.

The mechanism for cyclically reciprocating the pusher is disposed between the housing members 12,14, below the transparent top member 16. The mechanism includes a battery operated motor 42(FIGS. 2,3), with a rotor 43 which can turn about the central axis of a shaft 44 in a support member 45 that is fixed in the housing. The motor carries an integral cam in the form of a pin 46 which is disposed in a longitudinal cam follower slot 48 formed in the driver pusher member 30(*a*). The cam 46 and the cam follower slot 48 cooperate so that when the motor is turning about the central axis of the shaft 44, the driver pusher member 30 (*a*) and the slave pusher member 30(*b*) are caused to reciprocate. The drive and slave pusher members are constrained for substantially linear reciprocal movement by pins 50 fixed in the housing, and mating slots 52 formed in the pusher members.

An actuating lever 54 operates to initiate operation of the motor 42 or to trigger actuation of a timing mechanism for stopping operation of the motor. The actuating lever 54 is biased (by its own inertia) toward a position shown in FIGS. 2 and 5. In that position, it tilts forwardly through a slot (not shown) in the wall 25 which extends upward from the first one of the ledges 26. When coins are deposited into the inlet they act against actuating lever 54 and tilt it backward or clockwise about a pin 58 that is fixed in the housing. When the actuating lever 54 is tilted backward it initiates cycical operation of the pusher 30, in a manner described more fully hereinafter.

A shuttle member 60, a timing gear member 62, a battery operated drive circuit 64 for the motor, and a switch actuator 66(shown in phantom in FIGS. 4,5) are all disposed within the housing. The shuttle member 60 is a flat, planar member which is reciprocally driven by a lost motion connection with the pusher 30. The lost motion connection comprises a drive slot 61 in the shuttle member and the pin 63 in the pusher. Also, a pin 65 extending from the pusher engages a slot 67 in the shuttle member(FIG. 4).

The timing gear member 62 comprises two sets of teeth 68,70 and a pin 72 which can move in a slot 74 in the switch actuator 66. The switch actuator 66 is based clockwise about a shaft 76 that is fixed in the housing, by means of a pair of weights 80.

Figure 4:
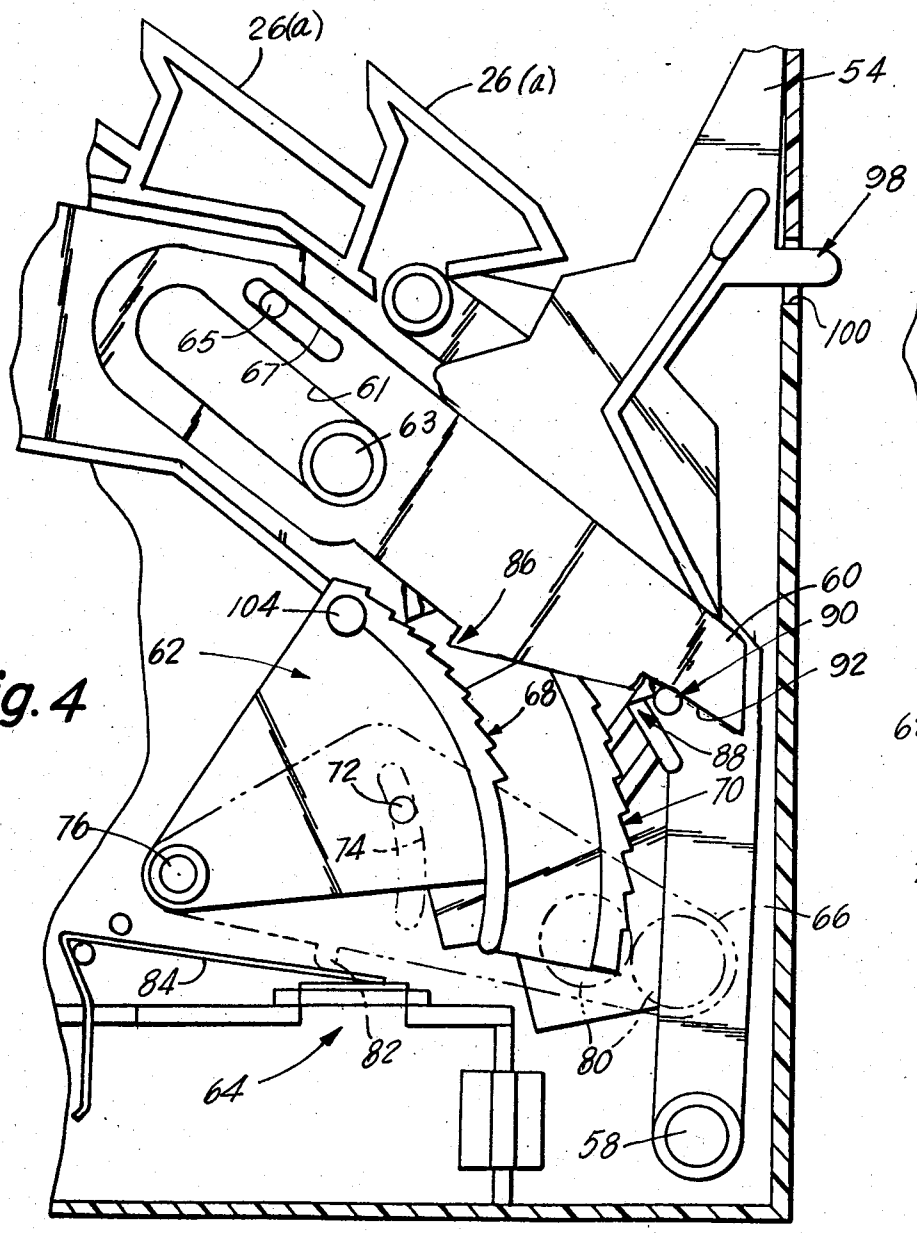
FIG. 4 is a schematic fragmentary view of a portion of the bank of FIG. 2, with some of the elements shown in FIG. 2 omitted.

The switch actuator member 66 has an integral finger 82 which, when the actuator member 66 is urged clockwise to the position of FIG. 4, by the weights 80, and exerts downward force on a spring finger contact 84 to complete the motor drive circuit 64 to energize the motor 42 and to cause the rotor 43 to turn about the central axis of the shaft 44. When the switch actuator member 66 is pivoted counterclockwise, the finger 82 is lifted(FIG. 5) and the spring contact finger 84 raises up, under its bias, to break the motor drive circuit and to deenergize the motor 42. The specific manner in which the switch actuator member 66 is controlled will be further apparent from the description which follows.

The timing gear 62 and the shuttle member 60 cooperate with the actuating lever 54 so that when a series of coins has been deposited into the bank, and the last coin has left engagement with the actuating lever 54, the pusher 30 will be cyclically reciprocated a predetermined number of times (preferrably corresponding to the number of ledges in the bank). Thus, the pusher 30 will continue to cyclically operate for a long enough period of time to push all of the coins through and off the ledges 26.

The lost motion coupling between the shuttle 60 and the pusher 30 causes the shuttle member 60 to be reciprocated a short distance at the end of each reciprocation of the pusher 30. The shuttle member 60 carries a tooth 86(FIGS. 4,5) aligned with the teeth 68 on the timing gear member 62. Additionally, the actuating lever 54 also carries a tooth 88 aligned with the teeth 70 on the timing gear member 62. The actuating lever 54 also carries a pin 90 and the shuttle member 60 has a surface 92 which can be engaged by the pin 90. When the actuating lever 54 is titled backward by the pressure of coin(s) disposed against it, the pin 90 causes the shuttle member 60 to raise slightly(FIG. 4) relative to the timing gear member 62 so that the tooth 86 on the shuttle member cannot engage teeth 68 on the timing gear 62 as the shuttle member is reciprocated. When the actuating lever 54 is allowed to pivot counterclockwise, i.e., because there are no coins against it, the shuttle is lowered relative to the timing gear member(FIG. 5) so that the tooth 86 on the shuttle member is aligned to engage the teeth 68 on the timing gear 62 and the tooth 88 on the actuating lever 54 is aligned to also engage teeth 70 on the timing gear 62. The lost motion coupling between the shuttle member 60 and the pusher 30 allows the shuttle member to pivot slightly, relative to the timing gear, to allow the shuttle member 60 to be raised and lowered relative to the timing gear member 62, thus allowing engagement or disengagement of the shuttle member with the timing gear in the manner set forth above.

Figure 5:
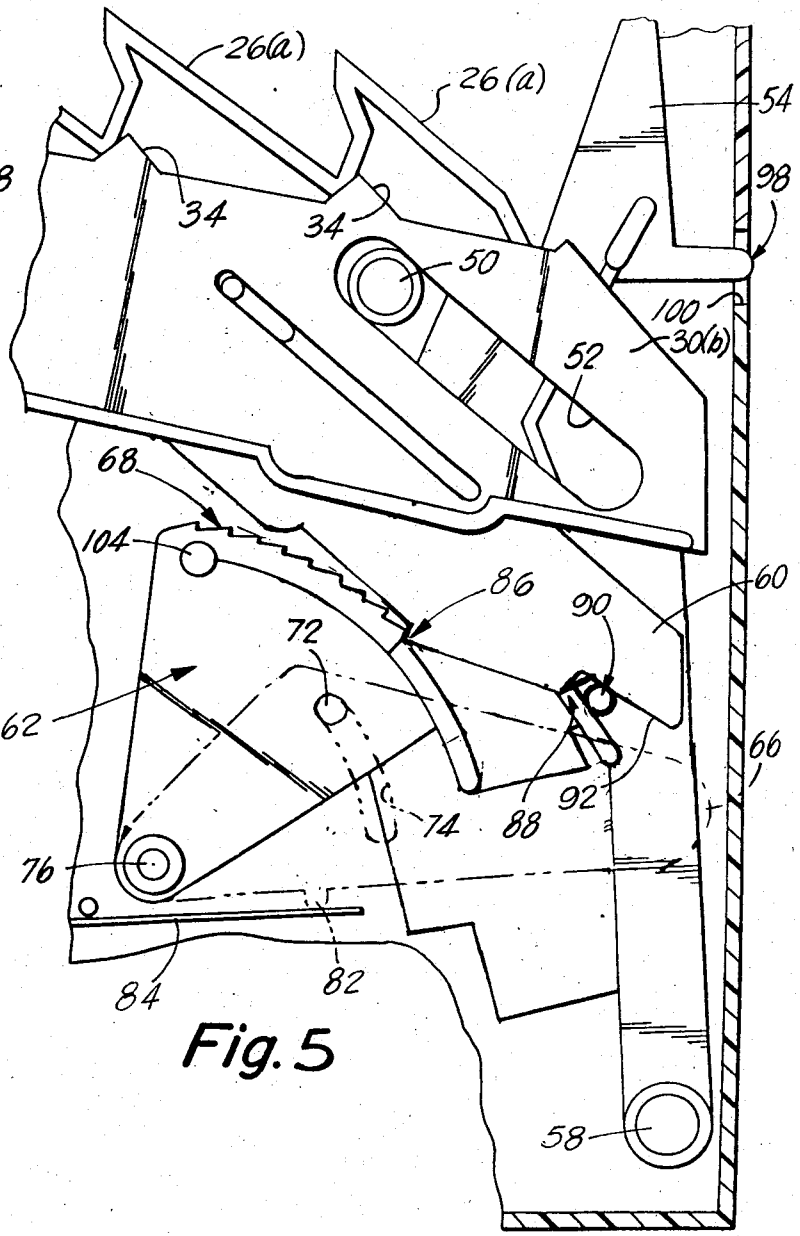
FIG. 5 is another schematic fragmentary view of a portion of the back of FIG. 2, but with other elements shown in FIG. 2 omitted.

When the last coin leaves the actuating lever 54, the actuating lever and the shuttle member 60 can pivot to positions in which their teeth 86,88 are disposed to engage respective teeth 68,70 of the timing gear. Each succeeding reciprocation of the pusher member 30 will reciprocate the shuttle member 60 an increment which will advance the timing gear 62 by one tooth. The tooth 88 on the actuating lever 54 can rachet over the teeth 70 on the timing gear as the timing gear is advanced, but the tooth 88 will engage one of the teeth 70 of the timing gear to prevent return movement of the timing gear. Thus, after coins have left engagement with the actuating lever 54, each succeeding reciprocation of the pusher 30 advances the timing gear 62 by one tooth. For a predetermined number of advancements of the timing gear 62, there is no engagement between the pin 72 on the timing gear and the slot 74 on the switch actuator 66. When the last coin is pushed off the last ledge 26, the shuttle member 60 makes one final reciprocation. That final reciprocation causes the pin 72 on the timing gear to engage the end wall of the slot 74 in the switch actuator 66(FIG. 5). The switch actuator 66 is then lifted from the position of FIG. 4, and the spring contact 84 returns under its bias to a position disengaging the motor drive circuit 64. The motor will remain in a disengaged condition until another coin, or group of coins, is deposited into the inlet 18 to tilt the actuating lever 54 backward, thereby releasing its tooth 88 from engagement with the timing gear 62. When that happens, the timing gear 62 moves clockwise under its bias and allows the switch actuator 66 to force the spring finger 84 downward to complete the motor drive circuit 64 and to initiate operation of the pusher 30 again.

It should be noted that the actuating lever 54 has a finger 98 that projects through an opening 100 in the housing. That finger allows manipulation of the actuating lever 54 in the event of a jam up of coins in the bottom of inlet 18. Additionally, there is a slot 102 in the back housing of the bank, and a finger 104 connected with the timing gear projects through the slot. Again, that allows manipulation of the timing gear, in the event of some kind of jam up, to break the motor drive circuit 64.

After a coin is pushed off the last ledge 26, the coin is sorted according to its diameter. Essentially, a coin drops onto a sorting track member 101, and is guided downwardly along the sorting track member toward a plurality of coin bins 110. The coin bins 110 preferably comprises portions 110(*a*) molded into the front housing member 12(see FIG. 2), and other portions molded into a door 113(FIG. 1) which can pivot relative to the front housing member 12 to allow coins to removed from the coin bins. The door 113 forms part of the out housing of the bank.

Figure 7:
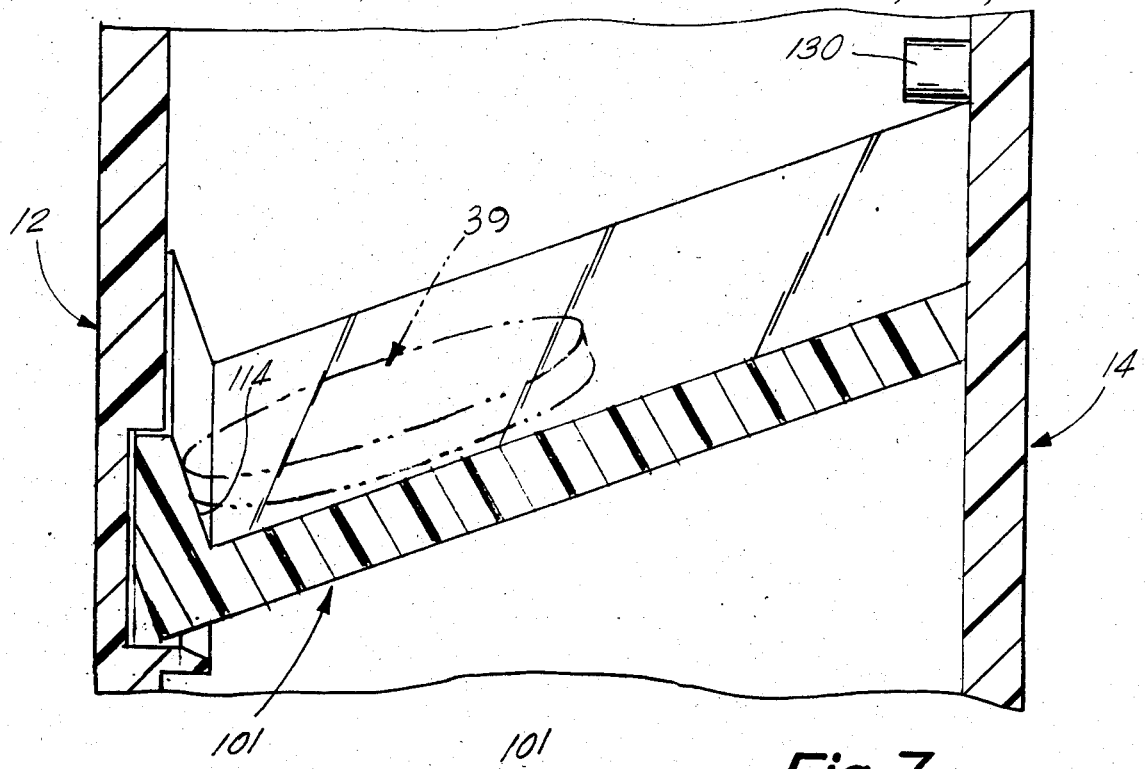
FIG. 7 is a sectional view of the bank of FIG. 2, on an enlarged scale, taken along the line 7—7.
Figure 10:
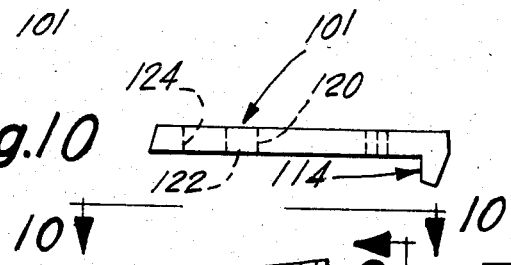
FIG. 10 is an end view of the sorting track member of FIG. 7, taken from the direction 10—10.
Figure 8:
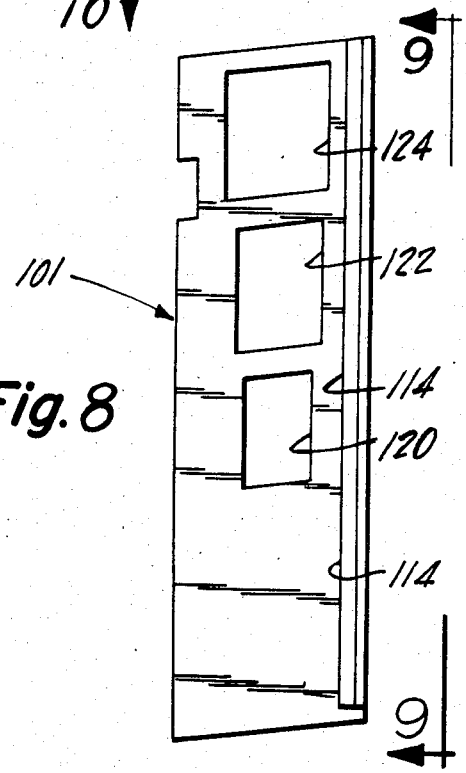
FIG. 8 is a top plan view of a sorting track member, constructed according to the principles of the invention.
Figure 9:
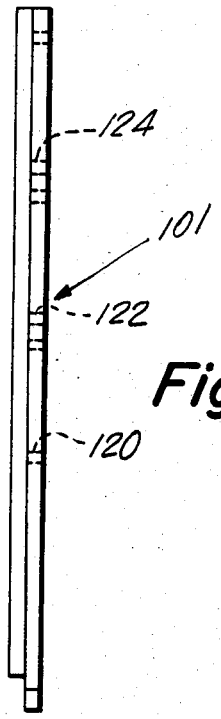
FIG. 9 is a side view of the sorting track member of FIG. 7, taken from the direction 9—9.
Figure 11A:
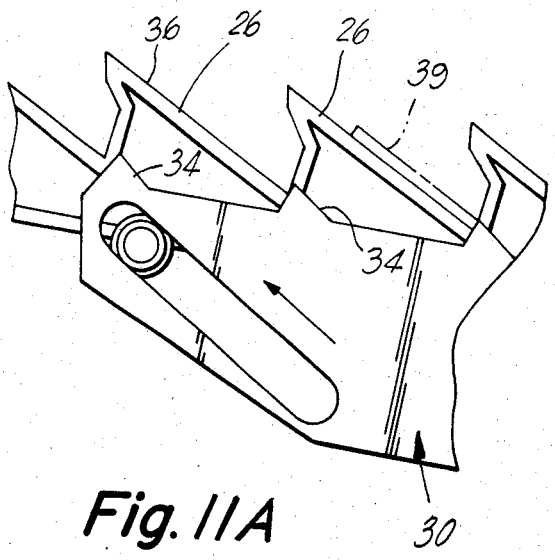
FIGS. 11(A–E) are schematic illustrations, showing the manner in which a coin is flipped over as it is moved between the successive ledges in a bank according to the principles of this invention.
Figure 11B:
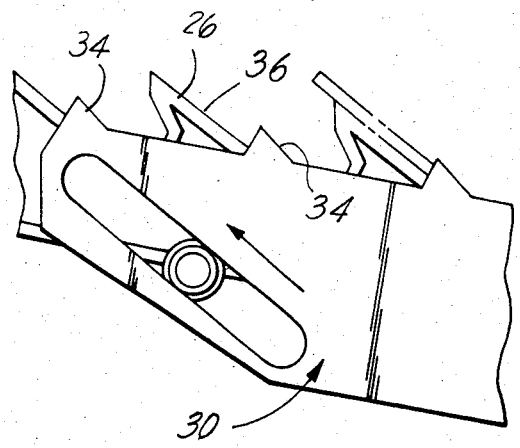
Figure 11C:
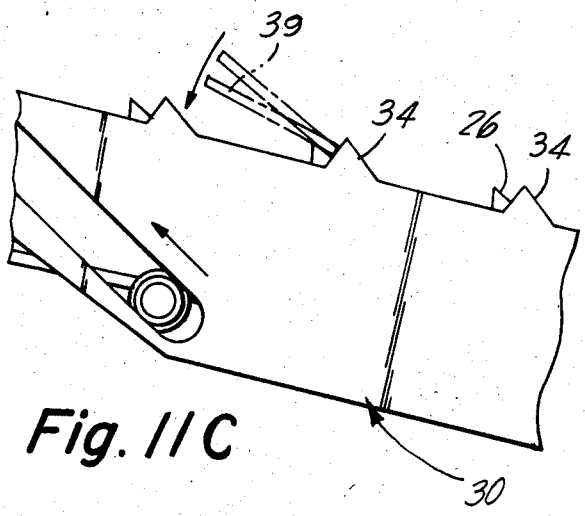
Figure 11D:
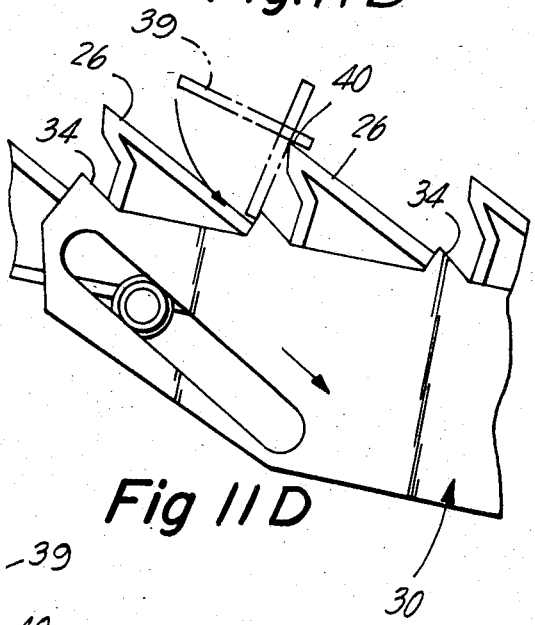
Figure 11E:
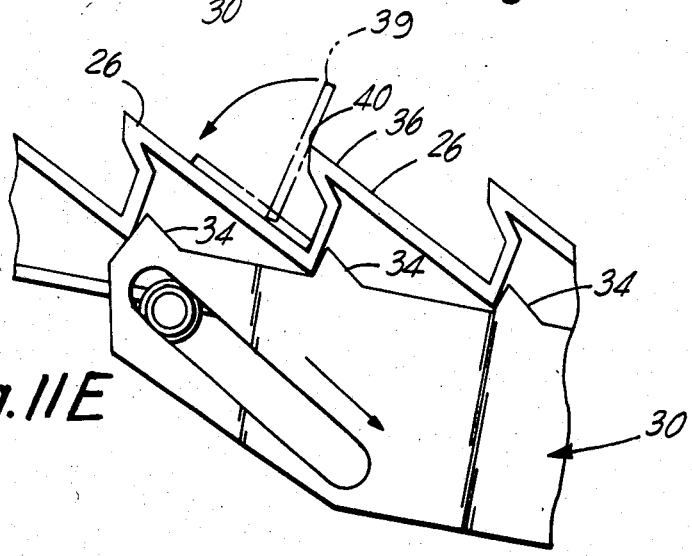

There is a wall (or curtain) 112 extending downward from the last ledge 26. The wall 112 has a lower edge 115 which is spaced above the sorting track member 101 and which is dimensioned to require a coin which has been dropped off the last ledge to assume a relatively flat position against the sorting track member 101 as the coin moves along the sorting track member. Additionally, the sorting track member 101 has a forward and downward tilt(FIGS. 2,7), requiring the edge of each coin(e.g. 39 in FIG. 7) to be maintained against a wall 114 formed in the sorting track member 101. As each coin moves along the wall 114, it either drops into a respective slot in the sorting track member or moves on toward a succeeding slot in the sorting track member. There is an initial slot 120 in the sorting track member designed to allow the smallest diameter coin to fall therethrough into a respective coin bin. There is a succeeding slot 122 for the next diameter coin and a third slot 124 for the next larger diameter coin. The largest diameter coin will pass over all the slots and simply slide off the edge of the sorting track member 101 and into the largest coin bin in the bank.

Importantly the dimension between the wall 114 and the slots in the sorting track member 101 are made to be precisely controlled for each particular currency. However, the sorting track member 101 is formed as a separate member, and that member can be specially designed for each currency, and can be separately molded for a particular currency. The sorting track member 101 is retained in the housing by a series of retaining pins 130 molded into the back housing member 14.

The coin bins 110 are molded into the plastic parts(e.g. front member 12) and are each dimensioned to receive coins of a predetermined diameter range. The dimensions of the coin bins can be designed so that a single set of coin bins has the capability to handle coins of several different currencies. The sorting track member 101 is specially molded for the particular currency which the bank is going to handle, with the dimensions of the slots 120, 122, 124, and their relation to the wall 114 specially dimensioned to sort coins of that currency. To design a bank for another currency, only a new mold for a sorting track member that can handle such currency has to be created. The same mold can be used for creating the housing parts.

With the principles of the invention, it is believed a unique and useful coin bank, particulary a coin sorting bank, can be designed to amuse the user, and to sort coins according to their diameters.

What is claimed is:

1. A coin bank comprising a housing having an inlet for receiving a group of coins of different diameters; a coin storage means for receiving coins of different diameters; means actuated by introduction of coins into said inlet for separating individual coins from a group deposited into said inlet and for advancing the separated coins in a moving file; and means for receiving coins from said moving file and for directing the coins to the coin storage means; said housing having a transparent wall disposed so as to allow coins in said moving file to be viewed therethrough.

2. A coin bank as defined in claim 1 wherein said inlet includes means for forming a group of coins into a stack; said means for separating and for advancing comprising means for successively separating coins from the bottom of tne stack and for advancing the separated coins in the moving file.

3. A coin bank as defined in said claim 2 wherein said means for separating and for advancing coins in the moving file comprises means for moving each of the coins separated from the stack through a plurality of successive stations and means for manipulating each coin as it moves through each station, so that the bank provides a unique visual effect as each coin in the moving file is manipulated as it is moved through each of the stations.

4. A coin bank as defined in claim 3 wherein a plurality of ledges are disposed in the housing, each ledge being disposed at a respective station, and said means for separating and for advancing being adapted to move coins successively against said ledges, said ledges and said means for separating and for advancing cooperating to manipulate coins and to move the coins between successive ledges.

5. A coin bank as defined in claim 4 wherein said ledges are oriented to engage the flat sides or coins in said moving file, and said ledges are adapted so that when a coin moves from one ledge to another, the coin is flipped and the opposite flat side of the coin engages the succeeding ledge.

6. A coin bank as defined in claim 4 wherein said ledges comprise inclined ramps, the upper edge of each ramp being disposed above the lower end of the succeeding ramp, the ramps cooperating with the means for separating and for advancing to manipulate a coin as the coin is moved between successive ramps.

7. A coin bank as set forth in claim 6 wherein the ramps are oriented relative to each other to cause a coin to be flipped over as it is moved from one ramp to another.

8. A coin bank as defined in claim 6 wherein the ramps are oriented relative to each other such that when a coin is pushed off one ramp and onto a succeeding ramp, the coin is flipped and its opposite face engages the succeeding ramp.

9. A coin bank as defined in claim 8, wherein said means actuated by introduction of coins into said inlet for separating and for advancing comprises a movable pusher associated with said ramps, said movable pusher being adapted to push a coin off one ramp and toward the succeeding ramp.

10. A coin bank as defined in claim 9 wherein a first ramp is disposed to receive the lower end of a stack of coins deposited in said inlet, said pusher adapted to separate a coin from said stack and to push said coin toward the succeeding ramp.

11. A coin bank as set forth in claim 10 wherein said pusher is cyclically operable to remove a coin from said stack and to push the coin off the first ledge.

12. A coin bank as set forth in claim 11 wherein said pusher is adapted to simultaneously push coins off each of said ledges as said pusher pushes a coin off the first ledge during each cycle of its operation.

13. A coin bank as set forth in claim 12 wherein said pusher is cyclically operable a predetermined number of times after the last coin in a stack is pushed off the first ledge, so that coins are advanced through each station and are pushed off each of the ledges before cyclical operation of said pusher is stopped.

14. A coin bank as set forth in claim 13 wherein cyclical operation of said pusher is initiated upon introduction of a coin into said inlet.

15. A coin bank as set forth in claim 14 including motor means energizable to cyclically operate said pusher, means engageable with a coin introduced into said bank for energizing said motor means, and timing means for maintaining operation of said motor to cyclically operate said pusher a predetermined number of cycles after a last coin has been pushed off said first ledge.

16. A coin bank as set forth in any of claims 1–5, further including a plurality of coin bins, each for receiving coins of a predetermined diameter range, and means for sorting the coins in said moving file according to their diameters and for directing the sorted coins to respective coin bins.

17. A coin bank as set forth in claim 16, including a housing comprised of a plurality of molded housing parts which are connected together to form said coin bins; said sorting means comprising a sorting member for directing coins of different diameters to respective coin bins; said sorting member being formed as a separate molded element which is connected with said housing parts, said coin bins each being capable of receiving coins of different currencies, and the provision of a separate molded sorting element allowing a single housing to be specially formed to sort coins of a particular currency by molding the sorting element to sort coins of that currency.

18. A coin bank as set forth in claim 17 wherein said housing comprises two molded members that are joined together and define a space therebetween, and said track element is retained in said space between said molded housing members.

19. A coin sorting bank as set forth in claim 18 wherein said track element is disposed in said housing in an orientation that allows coins to move therealong under gravitational/inertial forces, said track element including a wall for engaging the edge of coins moving along said track element under gravitational/inertial forces, said track element including plural slot means disposed thereon, each slot means having a predetermined geometrical relationship to said wall to allow coins of a certain specified diameter to fall therethrough.

* * * * *